US006892513B1

(12) United States Patent
Barr et al.

(10) Patent No.: US 6,892,513 B1
(45) Date of Patent: May 17, 2005

(54) METHOD OF FORMING AND FILLING AN END LOAD CARTON WITH A FOOD DELIVERY SYSTEM

(75) Inventors: Christopher D. Barr, Grayslake, IL (US); Mark C. Mikol, Arlington Heights, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/661,171

(22) Filed: Sep. 13, 2000

Related U.S. Application Data

(63) Continuation-in-part of application No. 09/433,039, filed on Oct. 25, 1999, now abandoned.
(60) Provisional application No. 60/160,279, filed on Oct. 19, 1999.

(51) Int. Cl.[7] ..... B65B 5/10; B65B 7/00
(52) U.S. Cl. ..... 53/458; 53/467; 53/473; 53/475; 426/115; 426/119; 426/124; 426/396; 426/411
(58) Field of Search ..... 426/115, 392, 426/394, 119, 411, 124, 396; 229/902, 906, 121, 122.2, 247, 407, 160.1, 87.08, 87.13, 122, 125.125; 206/804; 53/467, 473, 475, 491, 242, 243, 458, 247

(56) References Cited

U.S. PATENT DOCUMENTS

| | | | | |
|---|---|---|---|---|
| 411,398 | A | * 9/1889 | Soper | |
| 422,032 | A | 2/1890 | Munson | 229/122 |
| 953,132 | A | 3/1910 | Fischer | 229/122.34 |
| 1,080,933 | A | * 12/1913 | Sellman | |
| 1,657,272 | A | * 1/1928 | Neusbaum | |
| 1,790,370 | A | 1/1931 | Earman | 206/267 |
| 2,011,383 | A | 8/1935 | Taylor | 229/194 |
| 2,209,200 | A | 7/1940 | Hanson | 229/162 |
| 2,300,703 | A | 11/1942 | Ray | 229/217 |
| 2,396,150 | A | * 3/1946 | Bonville | |
| 2,396,310 | A | * 3/1946 | Yungblut | |
| 2,441,445 | A | * 5/1948 | Ringler et al. | |
| 2,527,705 | A | 10/1950 | Crary et al. | 229/117.26 |
| 2,626,096 | A | 1/1953 | Hickin | 229/242 |
| 2,679,349 | A | 5/1954 | Mullinix | 229/103.2 |
| 2,874,524 | A | 2/1959 | Ringler | 53/449 |
| 2,936,937 | A | 5/1960 | Guyer | 225/48 |
| 2,936,944 | A | * 5/1960 | Moore | 229/125.125 |
| 2,953,293 | A | 9/1960 | Anderson | 229/207 |
| 2,963,213 | A | 12/1960 | Nauman | 229/224 |

(Continued)

FOREIGN PATENT DOCUMENTS

| | | |
|---|---|---|
| CA | 606816 | 10/1960 |
| DE | 42 06 546 A1 | 9/1993 |
| FR | 2596730 A * | 10/1987 |

OTHER PUBLICATIONS

U.S. Appl. No. 09/433,036, Barr.
U.S. Appl. No. 09/433,038, Barr et al.
U.S. Appl. No. 29/112,549, Barr.
U.S. Appl. No. 09/433,039, Barr et al.

*Primary Examiner*—Milton I. Cano
*Assistant Examiner*—Robert Madsen
(74) *Attorney, Agent, or Firm*—Fitch, Even, Tabin & Flannery

(57) ABSTRACT

The invention provides a food packaging system that preferably includes a system for facilitating progressive or incremental delivery of individual, single-serving hand-held food items to the consumer, along with a carton for containing a plurality of the food items and associated delivery systems. The packaging system provides protection for the food items during packaging, shipping handling, retail display and consumer use, and also makes them readily accessible to the consumer, without requiring direct manual contact with the food item. The packaging system preferably includes a separate disposable delivery system for each food item.

12 Claims, 17 Drawing Sheets

U.S. PATENT DOCUMENTS

| | | | | | |
|---|---|---|---|---|---|
| 2,983,372 | A | | 5/1961 | Amatel et al. | 206/419 |
| 3,009,621 | A | * | 11/1961 | Wasserman | 229/221 |
| 3,019,959 | A | | 2/1962 | Skowronski | 229/224 |
| 3,049,281 | A | | 8/1962 | Vines | 229/247 |
| 3,073,501 | A | | 1/1963 | Williamson | 229/212 |
| 3,184,147 | A | | 5/1965 | Wolowicz | 206/557 |
| 3,186,623 | A | | 6/1965 | Guyer | 229/207 |
| 3,298,595 | A | | 1/1967 | Collura | 206/557 |
| 3,311,328 | A | * | 3/1967 | Slater | |
| 3,367,552 | A | * | 2/1968 | Krsyanowski | 206/250 |
| 3,400,877 | A | * | 9/1968 | Pierce, Jr. | |
| 3,423,005 | A | * | 1/1969 | Leibson et al. | |
| 3,506,184 | A | | 4/1970 | Barnes | 229/227 |
| 3,521,809 | A | | 7/1970 | Zimmerman | 229/207 |
| 3,655,111 | A | | 4/1972 | Surerus | 206/515 |
| 3,735,914 | A | | 5/1973 | Collura et al. | 229/207 |
| 3,794,238 | A | | 2/1974 | Egli | 229/145 |
| 3,863,829 | A | | 2/1975 | Merrill | 206/766 |
| 3,905,646 | A | | 9/1975 | Brackmann et al. | 206/155 |
| 3,982,685 | A | | 9/1976 | Shimada | 229/51 TS |
| 4,070,489 | A | | 1/1978 | Pahnke | 426/115 |
| 4,081,126 | A | * | 3/1978 | Barnard | 206/256 |
| 4,083,455 | A | | 4/1978 | Keating, Jr. | 206/625 |
| 4,158,412 | A | | 6/1979 | Wysocki | 206/612 |
| 4,189,054 | A | | 2/1980 | Liu et al. | 206/634 |
| 4,317,518 | A | | 3/1982 | Mode | 206/626 |
| 4,405,066 | A | | 9/1983 | Roccaforte | 225/43 |
| 4,417,678 | A | | 11/1983 | Roccaforte | 225/43 |
| 4,449,633 | A | | 5/1984 | Johnson et al. | 206/612 |
| 4,513,863 | A | * | 4/1985 | Schillinger | 206/264 |
| 4,604,290 | A | | 8/1986 | Lee et al. | 426/533 |
| D293,211 | S | | 12/1987 | DePaul et al. | D9/416 |
| 4,712,737 | A | | 12/1987 | Hecking | 239/58 |
| 4,721,622 | A | * | 1/1988 | Kingham et al. | 426/94 |
| 4,738,359 | A | * | 4/1988 | Phillips, Jr. | 206/256 |
| 4,756,470 | A | | 7/1988 | DePaul | 229/134 |
| 4,804,137 | A | | 2/1989 | Harby | 229/114 |
| 4,821,951 | A | | 4/1989 | Franzoni | 229/162 |
| 4,963,385 | A | | 10/1990 | Antrim et al. | 426/602 |
| 5,014,855 | A | | 5/1991 | Roccaforte | 206/616 |
| 5,015,483 | A | | 5/1991 | Haynes et al. | 426/73 |
| 5,035,330 | A | | 7/1991 | Kuchenbecker | 206/621.4 |
| 5,161,733 | A | | 11/1992 | Latif | 229/225 |
| 5,167,324 | A | | 12/1992 | Miller | 206/44 |
| 5,181,649 | A | | 1/1993 | Frost | 229/19 |
| 5,234,702 | A | | 8/1993 | Katz et al. | 426/72 |
| 5,277,304 | A | * | 1/1994 | Brizzi et al. | 206/256 |
| 5,314,114 | A | * | 5/1994 | Stone | 229/225 |
| 5,326,575 | A | | 7/1994 | Spaulding | 426/87 |
| 5,341,626 | A | * | 8/1994 | Beckmann | 53/566 |
| 5,518,174 | A | | 5/1996 | Botterman | 229/207 |
| 5,531,376 | A | | 7/1996 | Brink et al. | 229/207 |
| 5,573,177 | A | | 11/1996 | Hough | 229/207 |
| D376,759 | S | | 12/1996 | Bradfield | D9/432 |
| 5,660,323 | A | | 8/1997 | Spronk | 229/215 |
| D394,606 | S | | 5/1998 | Zorn et al. | D9/432 |
| 5,826,785 | A | | 10/1998 | Belvederi et al. | 229/162 |
| 5,934,551 | A | | 8/1999 | Kaufman | 229/162 |
| 6,033,699 | A | | 3/2000 | Vincenzi | 426/106 |

* cited by examiner

METHOD OF FORMING AND FILLING AN END LOAD CARTON WITH A FOOD DELIVERY SYSTEM

This is a continuation-in-part of non-provisional application Ser. No. 09/433,039, filed Oct. 25, 1999, now abandoned, and prior provisional application Ser. No. 60/160,279, filed Oct. 19, 1999.

BACKGROUND OF THE INVENTION

1. Field of the Invention

The invention relates generally to containers for food products, and more particularly to a food delivery system and associated packaging for hand-held food products.

2. Background and Description of Related Art

In recent years, there has been increased interest in hand-held foods, e.g., single serve food items for consumption without utensils. Such items are intended to be easily handled by the consumer so that they can be eaten in a variety of circumstances, e.g., while driving, without requiring a great deal of time and attention, preferably without leaving residue on the consumer's fingers. In providing a container for this type of product, among the considerations that must be addressed are the ability of the container to receive product in high-speed commercial filling operations; the degree of difficulty that will be encountered by the consumer in dispensing product from the container; the ability of the container to withstand various loads, such as stacking loads, during filling, sealing, shipping, display, and consumer use; the ability of the container to be packed efficiently among like containers; the cost of manufacture of the container; the ability of the container to exclude air to enable acceptable shelf life to be maintained, and the costs and difficulty associated with forming, filling and sealing the container. It is also important that containers of this type be aesthetically pleasing where they are intended to be displayed for commercial sale to consumers in grocery stores and/or other retail establishments.

It is a general object of the invention to provide a lightweight, economical, commercially viable container for food products which adequately addresses the above considerations, and which includes a food delivery system to facilitate dispensing of single servings of hand-held food products.

SUMMARY OF THE INVENTION

The invention provides a food packaging system that preferably includes a system for facilitating progressive or incremental delivery of individual, single-serving hand-held food items to the consumer, along with a carton for containing a plurality of the food items and associated delivery systems. The packaging system provides protection for the food items during packaging, shipping, handling, retail display and consumer use, and also makes them readily accessible to the consumer, without requiring direct manual contact with the food item. The packaging system preferably includes a separate disposable delivery system for each food item.

The food delivery system preferably comprises an elongated tray supporting the food item within an overwrap. The tray preferably has sufficient strength and stiffness to withstand compression loads experienced during packaging, shipping, handling, retail display and consumer use, but also includes at least one predetermined area of weakness to facilitate controlled incremental bending of the tray to improve accessibility to the food item during incremental dispensing thereof. To this end, each side wall preferably comprises a plurality of distinct segments with frangible portions therebetween. The tray preferably may be bent or folded away from the food item so that one end portion of the food item is exposed on all sides while another end portion remains covered by the tray and overwrap to facilitate handling. The tray preferably comprises a bottom wall, a pair of side walls and a pair of end walls to withstand compression on all sides. The end walls enable the product to be withdrawn upwardly from the overwrap after an end of the overwrap has been opened or removed, by pulling upward on the tray, with one of the end walls of the tray being below the food product to push it upward, without requiring the consumer to handle the food product directly.

Each area of weakness preferably include notches in the side walls extending a portion of the height of each side wall, and a line of weakness extending from the bottom of each notch to the bottom wall. The notches and lines of weakness enable the sidewalls to be divided or split at predetermined locations by bending of the tray. To facilitate controlled folding of the bottom wall, the bottom wall includes a weakened area along a line extending between the lines of weakness in the sidewalls. This weakened area may comprise, e.g., an area of reduced thickness, a score line, a line of perforation, or other means to control bending. The tray may have upper regions of the side walls configured to facilitate engagement by the fingers of a person holding the food delivery system, e.g., one or more curved recesses in the upper edges of the side walls.

The overwrap preferably is hermetic, and may contain a gas flushed environment. The overwrap also preferably comprises a weakened area to facilitate opening. It may be made from one or more layers of suitable food-grade film of plastic material or the like, metal foil and/or paper.

The food item may comprise, for example, breakfast bars or other farinaceous products. One particular food item that may be packaged in accordance with the invention comprises a cream cheese component disposed within a larger farinaceous component or sandwiched between a pair of farinaceous components. The farinaceous components may comprise, e.g., baked bread products, bagel products or other products.

The carton may comprise a side-load carton or an end-load carton. The side-load carton may be assembled by a novel sequence of assembly steps wherein side walls for the carton and side portions of the cover can be formed efficiently and economically to provide a secure yet easily openable, commercially acceptable container.

Filling of the side-load carton involves positioning of food products in their associated delivery systems in horizontal rows of three, then pushing them into the container using a mandrel or the like, with the mandrel contacting one pair of delivery systems only. In the end-load carton, the mandrel may act directly on each of the delivery systems, which may reduce compression loads on the delivery systems as compared with the loads experienced by the delivery systems in contact with the mandrel in the above-described filling arrangement for the side-load carton.

The carton or reclosable display and dispensing container stands upright without support, and is thus, free-standing. Thus, once the carton is opened, or the top is removed by ripping off the cover along the line of weakness, the food items contained therein are readily available for accessibility by the consumer. This free-standing container may be placed on the kitchen shelf or in the refrigerator as an easy access to the food products contained therein. Moreover, the wrapping of the food product item contained therein has edges on the opposite ends of the food product bar. Thus, when the carton is opened, or the cover is ripped off, the several food product bars contained therein have edges to the wrapping which facilitates grasping by a consumer wishing to remove a food product bar from the display and dispensing container.

DETAILED DESCRIPTION OF THE PREFERRED EMBODIMENTS

Figure 1:
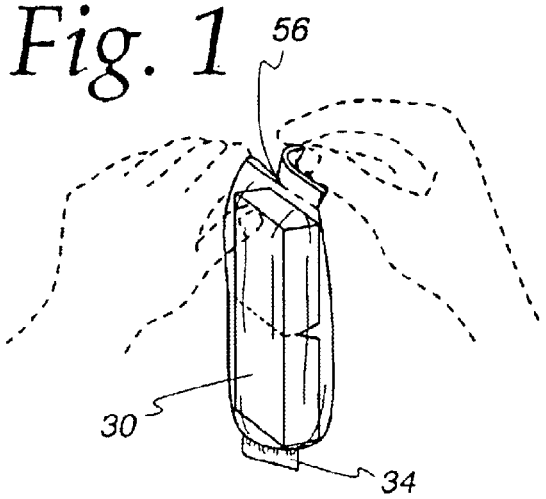
FIGS. 1–4 are diagrammatic perspective views illustrating a method of using a food delivery system in accordance with a first embodiment of the invention.
Figure 2:
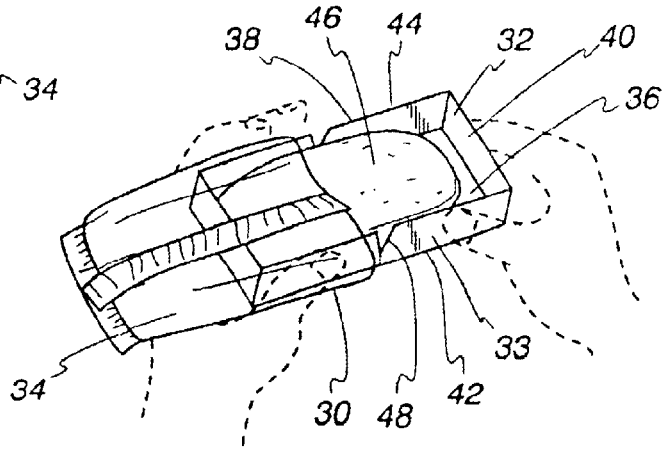
Figure 3:
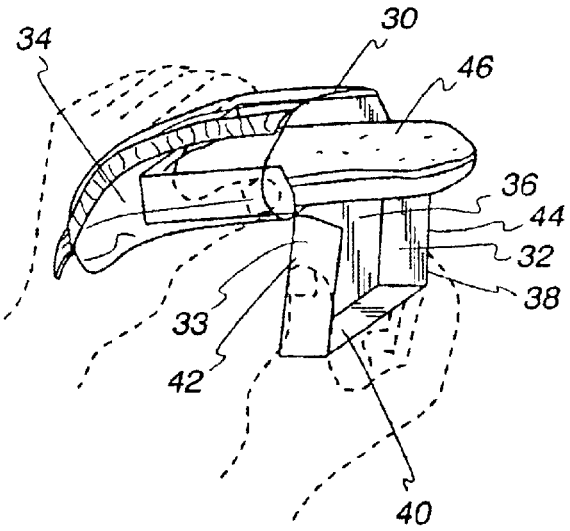
Figure 4:
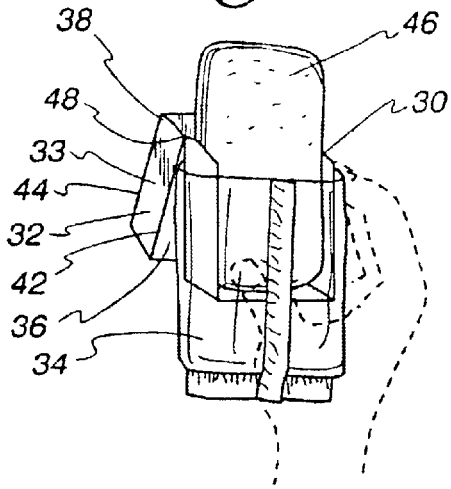

The invention is preferably embodied in a packaging system that includes a food delivery system as shown in FIGS. 1–6, in combination with a carton as shown in FIGS. 7–27. In the illustrated embodiments, the packaging system is used in conjunction with hand-held foods, i.e., edible items that may be held in a consumer's hand for consumption without utensils. In other embodiments, the packaging system may be used in conjunction with other food products.

For the purpose of illustrating the food-delivery system of the invention, there are shown in the drawings, which form a material part of this disclosure, preferred embodiments of the invention. The various components of the food delivery system of the present invention may be generally arranged as shown in the drawings, or as described herein below. However, the invention is not limited to the precise arrangements, configurations, dimensions and/or instrumentalities shown in these drawings, or described herein below. The arrangements, configurations, dimensions and instrumentalities may be otherwise, as circumstances require.

A preferred embodiment of the food delivery system will now be described with reference to the drawings. In the drawings, like reference symbols indicate the same components throughout the different views.

FIGS. 1–4 show a food delivery system 30 in accordance with a first embodiment of the invention and its method of use. The food delivery system of FIGS. 1–4 generally includes an elongated tray 32 in which the food item 46 is positioned, and an overwrap 34 for the tray and food item.

The elongated tray includes a bottom wall 36, side walls 38, and end walls 40, each side wall 38 having a bottom edge 42 joined to the bottom wall and a top edge 44. The bottom wall 36, side walls 38 and end walls 40 may be held in their positions in any suitable manner, e.g., by adhesives, fasteners, notches and slots in the walls, or other means for maintaining the walls in a fixed relationship to one another. The tray 32 preferably has sufficient strength and stiffness to withstand compression loads experienced during packaging, shipping, handling, retail display and consumer use, but also includes at least one predetermined area of weakness to facilitate controlled bending of the tray to improve accessibility to the food item during progressive dispensing thereof. To this end, each side wall preferably comprises a plurality of distinct segments 33 with frangible portions therebetween. The tray preferably may be bent or folded away from the food item 46 so that one end portion of the food item is exposed on all sides while another end portion remains covered by the tray 32 and overwrap 34 to facilitate handling.

In the illustrated embodiment, the tray 32 comprises a generally rectangular bottom wall 36, a pair of generally rectangular side walls 38, and a pair of generally rectangular end walls 40 to enable the tray to withstand loads on all sides. The end walls enable the product to be withdrawn upwardly from the overwrap after an end of the overwrap has been opened or removed, by pulling upward on the tray, with one of the end walls of the tray being below the food product 46 to push it upward, without requiring the consumer to handle the food product directly. As alternatives to the generally rectangular configuration of the tray in the illustrated embodiments, the tray may, in other embodiments of the invention, be rectangular, elliptical, or even triangular in shape, depending on the food product's geometry.

Each frangible portion preferably is defined by an area of weakness that includes slots or notches 48 in the side walls extending a portion of the height of each side wall 38, and a line of weakness such as a score line or a perforation 50 extending from the bottom of each notch 48 to the bottom wall 36. The notches 48 and lines 50 of weakness enable the sidewalls to be divided or split at predetermined locations by bending of the tray. In the illustrated embodiments, each of the slots in the sidewalls comprises a notch extending between about ¼ and about ¾ of the distance from the top edge of the side wall to the bottom edge of the side wall. Such notches 48 may be any suitable shape which serves to facilitate splitting or tearing the side wall 38 so that the tray may be bent backward.

To facilitate controlled folding of the bottom wall, the bottom wall 36 includes one or more weakened areas 52. Each weakened area 52 may comprise, e.g., an area of reduced thickness, a score line, a line of perforation, or other means to control bending. Each weakened area 52 extends between a pair of slots 48. Thus, the notches 48, perforated areas of the side walls 50, and weakened areas 52 of the bottom wall work in conjunction with one another to facilitate controlled bending of the tray. Such slots 48 and weakened areas 52 are preferably spaced from an end of the tray by about one fifth to about one-half of the length of the tray 32.

Figure 5:
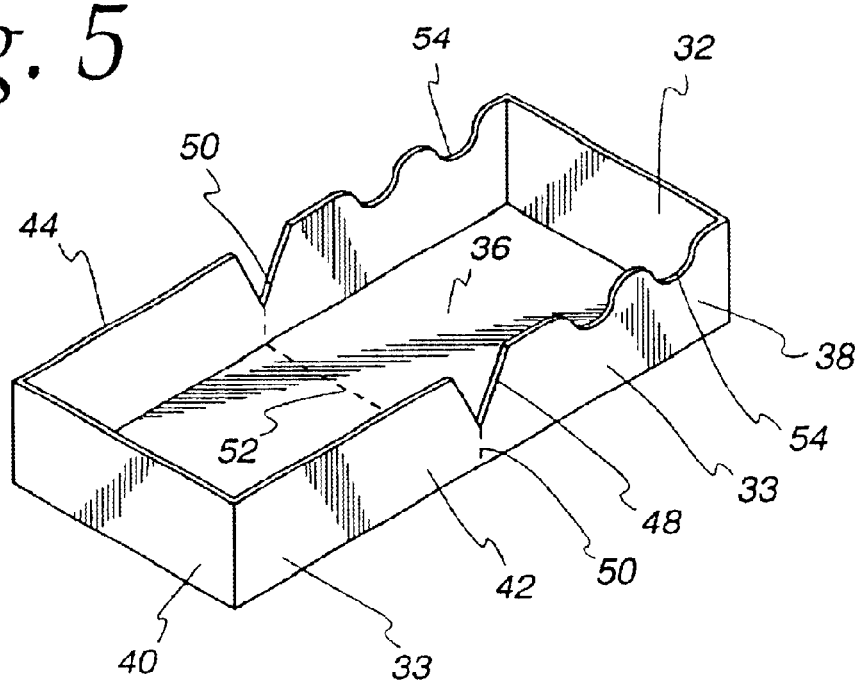
FIG. 5 is a perspective view illustrating an elongated tray in accordance with a second embodiment of the invention.

As shown in FIG. 5, the tray 32 may have upper regions of the side walls configured to facilitate engagement by the fingers of a person holding the food delivery system, e.g., one or more curved recesses 54 in the upper edges of the side walls. The recesses or finger grips 54 may be obtained by die-cutting the upper regions of the side walls. These regions are preferably configured such that the fingers of the consumer fit within these regions comfortably, and to this end are dimensioned to correspond to the approximate size and spacing of the fingers of a typical consumer of the product to ergonomically enhance the packaging.

The tray 32 in the preferred embodiments is made of a paperboard substrate, but in other embodiments might be made of plastics or other materials, or combinations of paperboard, plastics and/or other materials. Also, a susceptor may be incorporated into the tray 32. This would allow the food product to take on a crispy texture when microwaved. To assist in maintaining acceptable shelf life, an oxygen-scavenging system may be incorporated into one of the layers of the paperboard tray's laminate structure.

In one embodiment, the corners of the tray are secured by an automatically locking tab-in slot arrangement known as "Kliklok™". With this embodiment, a flat blank is folded by a tray forming a mandrel or other suitable apparatus, and the corners are locked together without requiring adhesive, and without requiring manual assembly.

The food item 46 may comprise, for example, any snack food or food that may be eaten on the run. For instance, a breakfast bar or other farinaceous product is one such product. One particular food item 46 that may be packaged in accordance with the invention comprises a cream cheese component disposed within a larger farinaceous component or sandwiched between a pair of farinaceous components. The farinaceous components may comprise, e.g., baked bread products, bagel products, bagel-like products, bagel-like products with cream cheese components, or other products. Susceptors may be incorporated into the paperboard and thereby allow the food product to be crisped and heated in a microwave. Food items that such technology would be used for are pizza-like products, burgers, other hot sandwich-like concoctions, and the like.

The overwrap 34 encloses the tray 32 and the food item 46. The illustrated overwrap 34 is formed from a single web of material, wrapped around the food item and closed by a longitudinal fin seal and transverse end seals. In the preferred embodiments, the overwrap is hermetic, and may contain a gas flushed environment. In other embodiments, for selected products, a cold seal pouch material could be used rather than a hermetically-sealable material, and the overwrap may be formed with cold seals, and may be non-hermetic.

The overwrap 34 preferably comprises a weakened area 56 to facilitate opening. The weakened area 56 may comprise, e.g., a series of scratches or the like in one or more layers of laminated film. Commercially available products providing weakened areas to facilitate opening that may be suitable include those marketed under the names "Magic Cut™" and "Fancy Cut™."

The overwrap 34 is preferably made of a flexible plastic film which may comprise, e.g., one or more layers of polyethylene, polypropylene, nylon, polyethylene terepthalate (PET), linear low density polyethylene (LLDPE) or other polymeric materials, and or metal foil, paper, or other suitable materials.

Figure 6:
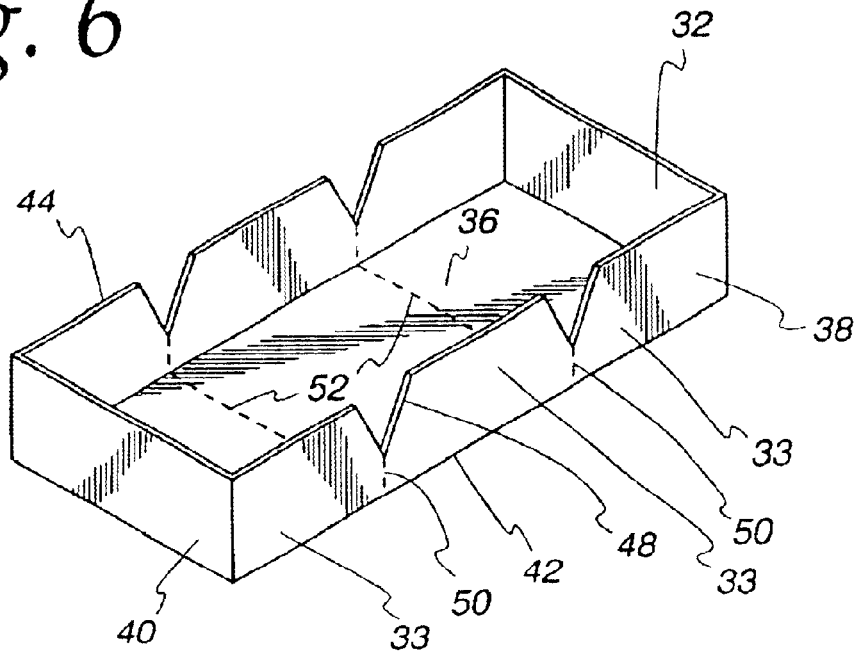
FIG. 6 is a perspective view illustrating an elongated tray for a food delivery system in accordance with a third embodiment of the invention.

As shown in FIG. 6, the tray 32 may include two pair of notches 48, with a respective lines of weakness extending down to 50 and across 52 the bottom wall between each pair. In other embodiments, three or more pair of notches 48, with associated lines of weakness, may be provided. The notch/perforation/score features, or other means to facilitate bending, may be located at any suitable locations along the side of the tray to optimize product delivery.

The dimensions of the tray may be variable. The length of the tray may vary from about 3.5 in about 5.5 in and is preferably about 4 in to about 5 in. The width of the tray may range from about 1 in to about 3 in, and is preferably, about 2 in. The depth of the tray may range from about 0.5 in to about 1.5 in, and is preferably, about 1 in.

A method of progressively dispensing a food item from a food delivery system is shown in FIGS. 1–4. The first step comprises opening an end of the overwrap 34 such that an end portion of the food item and tray are exposed. This may be done by tearing the overwrap open and displacing the food item 46 outward of the overwrap 34 to give access to the food item 46 to the consumer. Next, the side walls 38 are fractured at a pair of notches 48 and the tray 32 is bent backward to increase access to the food item. The exposed end portion of the food item 46 is then eaten, while the opposite end portion remains covered, and may be held by the consumer without direct manual contact with the food product. Where a tray having more than one pair of notches 48 is employed, the above steps may be repeated one or more times, with the tray 32 and food product 46 being advanced further, and bent again to expose further portions of the food product, while other portions remain covered so that the consumer is not required to handle the food product directly.

FIGS. 7–27 show cartons for containment of a plurality of the food products and delivery systems, and methods of forming, filling and sealing the cartons. In the embodiment of FIGS. 7–22, a side-load carton 60 is employed. In the embodiment of FIGS. 23–27, an end-load carton 62 is employed.

Each of the cartons comprises a display and dispensing container which defines an enclosed interior space for the food items and delivery systems. This container includes a flat-sided carton, which carton includes a bottom wall, two side walls, a front wall, a back wall, and cover hingedly connected to the back wall, and a means for reclosure.

The tray and cartons may be made of paperboard of any suitable thickness. For example, paperboard having a thickness of about 0.01 to 0.025 in. may be used, and in one particular embodiment, paperboard having a thickness of about 0.015 to about 0.022 in. is employed.

The dimensions of the side-load and the end-load carton may be variable. Each carton is provided to enclose a plurality of food items. The height of the cartons may range from about 4.5 in to about 6.5 in, and is, preferably, about 5.5 in. The width of the cartons may range from about 8 in to about 10 in, and is preferably, about 9 in. The depth of the cartons may range from about 1.5 in to about 3.0 in, and is preferably, about 2.4 in.

Side-Load Carton

In the side-load carton 60 of FIGS. 7–22, the cover 64 has a box shape, and includes a top portion 72, two side portions 74, and a front portion 68. Preferably, the sides of the cover 64 are formed using two side flaps 66 that are integral with the front portion 68, which are folded back and joined to two side flaps 70 that are integral with the top portion 72 and folded down therefrom so as to hold the cover 64 in a box-like arrangement. Thus, the side portion 74 is contiguous with the front portion 68 of the cover, and both side portions 74 and the front portion 68 are integral components of a single unitary, paperboard member that is uninterrupted by any exposed edge at the juncture between the side portion and the front portion. Thus, this juncture comprises a 90 degree bend or fold in a continuous portion of the paperboard member.

The side portions 74 of the cover overlap the side walls and the side portions of the cover have substantially horizontal bottom edges. The side walls 76 of the carton extend its full height, so that there is substantial overlap between the side portions of the cover 74 and the side walls 76 of the carton. The cover 64 may be hingedly connected to the back wall 78 along a region of weakness 80 such as a perforation, thereby permitting the cover 64 to be removed entirely to permit unrestricted access to the food items 46 contained within the container.

The container front wall 82 includes a window 84 to permit visual access to the food items 46 contained within the container. This window 84 can be made of any suitable transparent or translucent material such as a plastic film or the like.

The front portion 68 of the cover preferably is releasably attached to the front wall 82 by adhesive. Means for reclosure 88 are preferably provided in the form of a tab 90 and slot 92 engagement between the front portion of the cover 68 and the front wall 82 of the carton.

Figure 7:
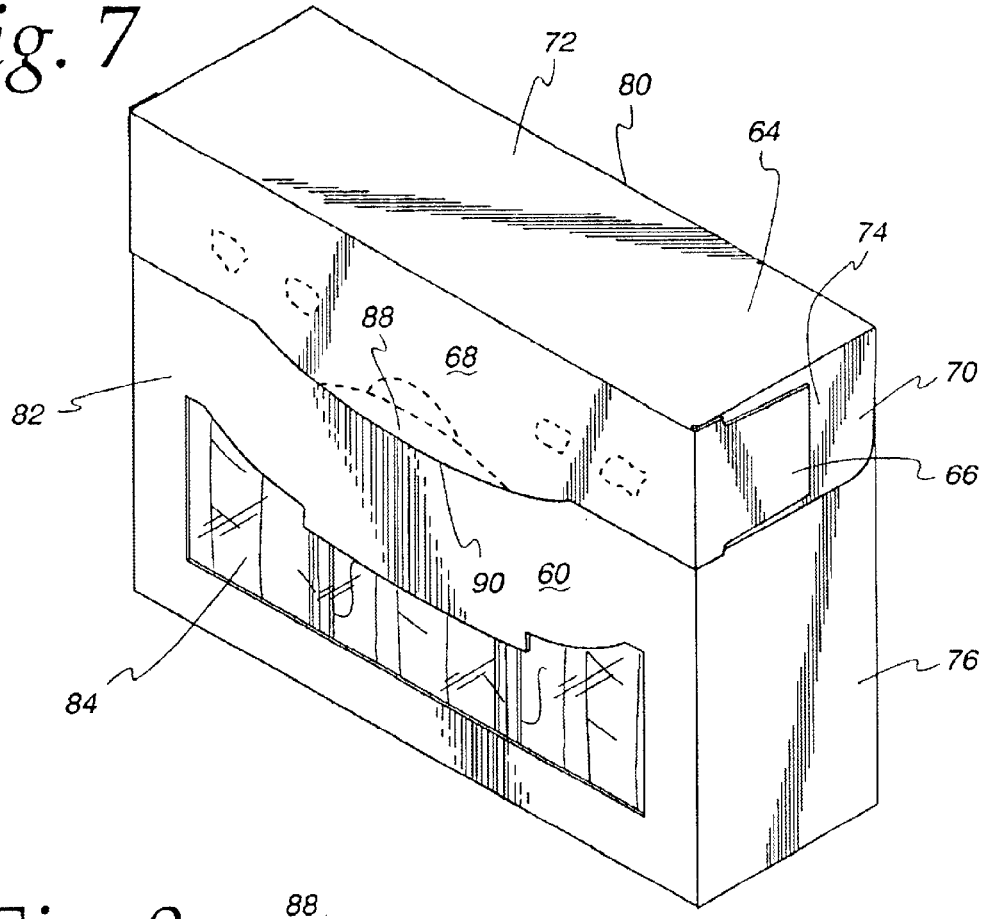
FIG. 7 is a perspective view illustrating a side load carton in accordance with an embodiment of the invention.
Figure 8:
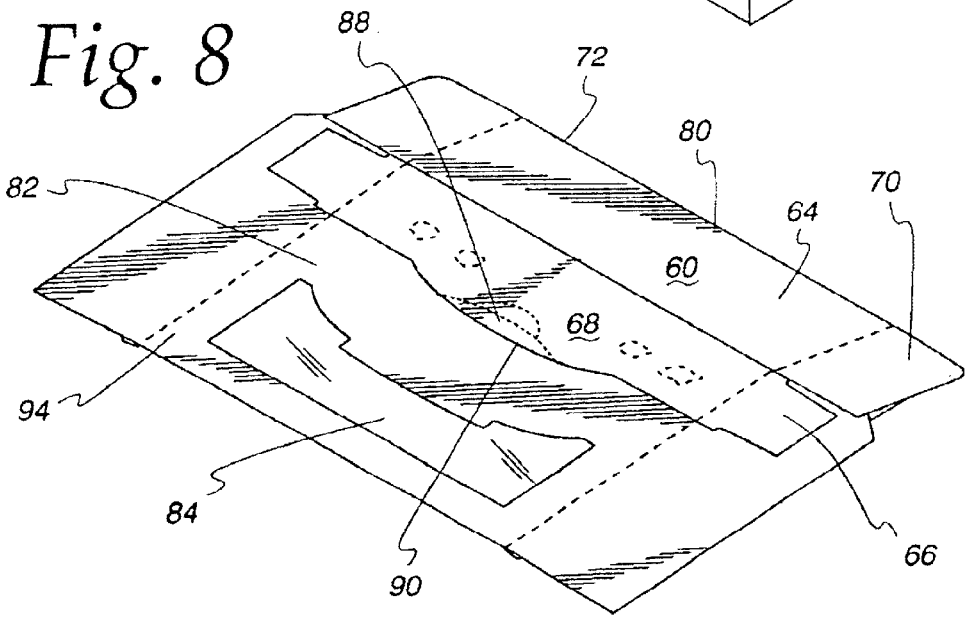
FIG. 8 is a perspective view illustrating a partially preglued, partially assembled precursor to the side load carton of FIG. 7.
Figure 9:
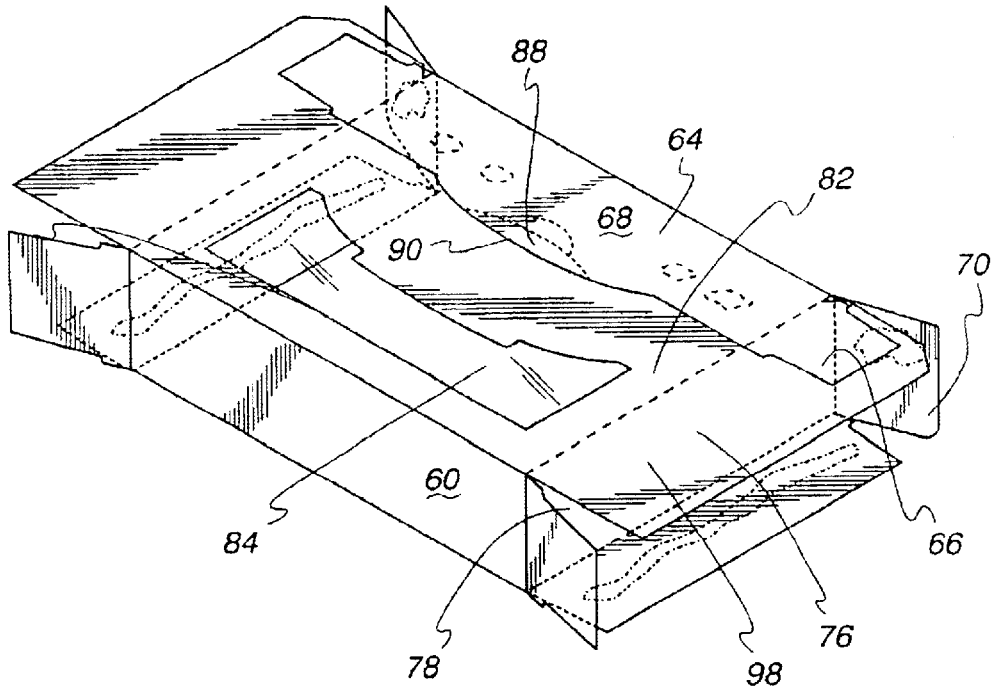
FIGS. 9–21 are perspective views illustrating a sequence of steps of assembling, filling, and sealing the side load carton of FIG. 7.
Figure 10:
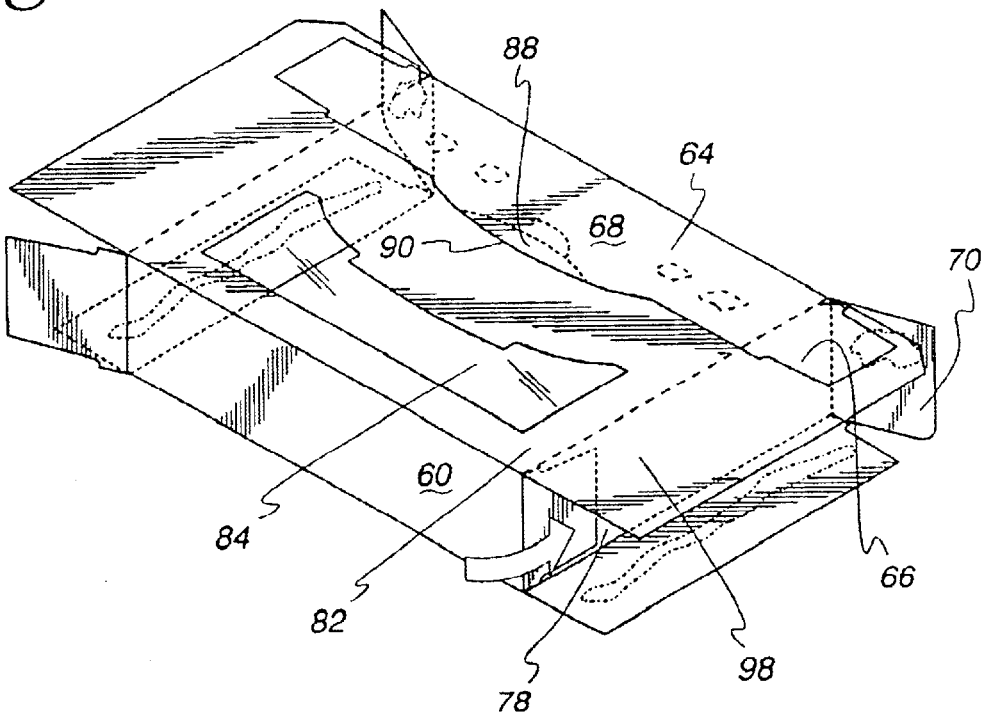
Figure 11:
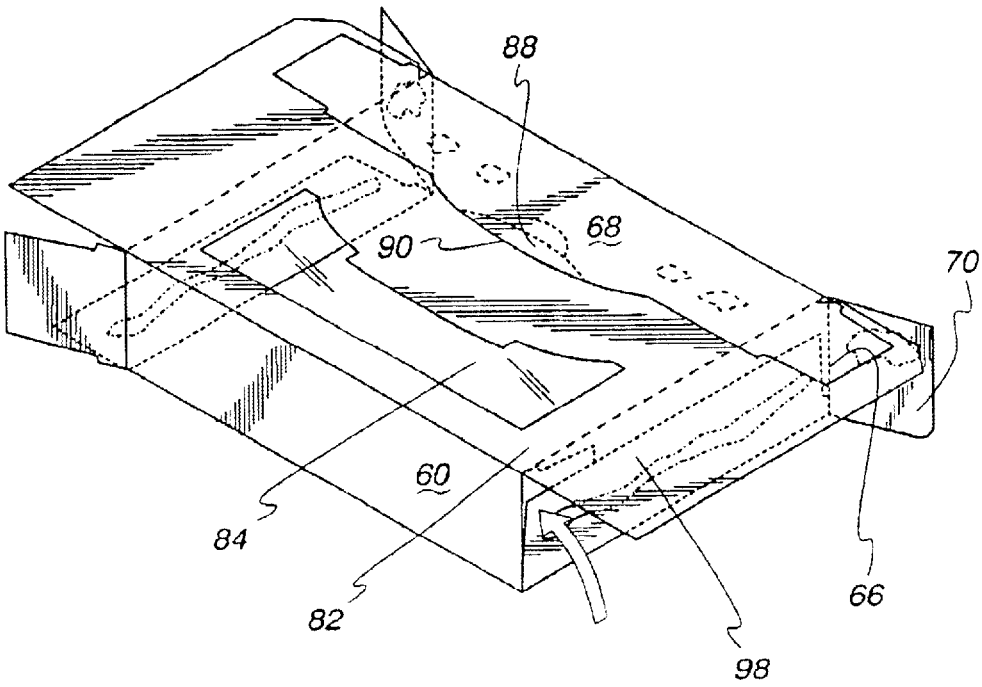
Figure 12:
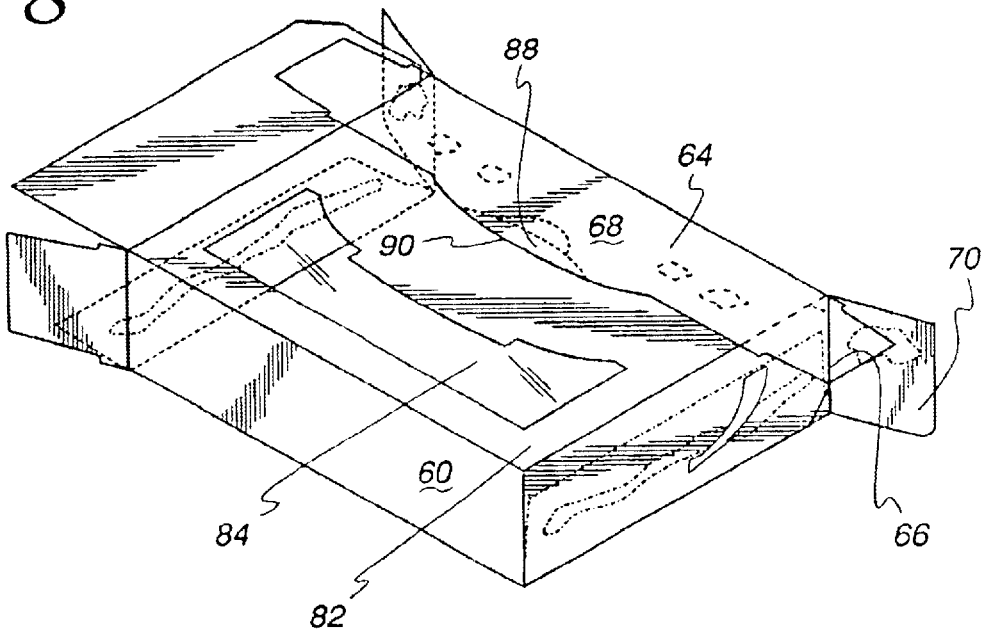
Figure 13:
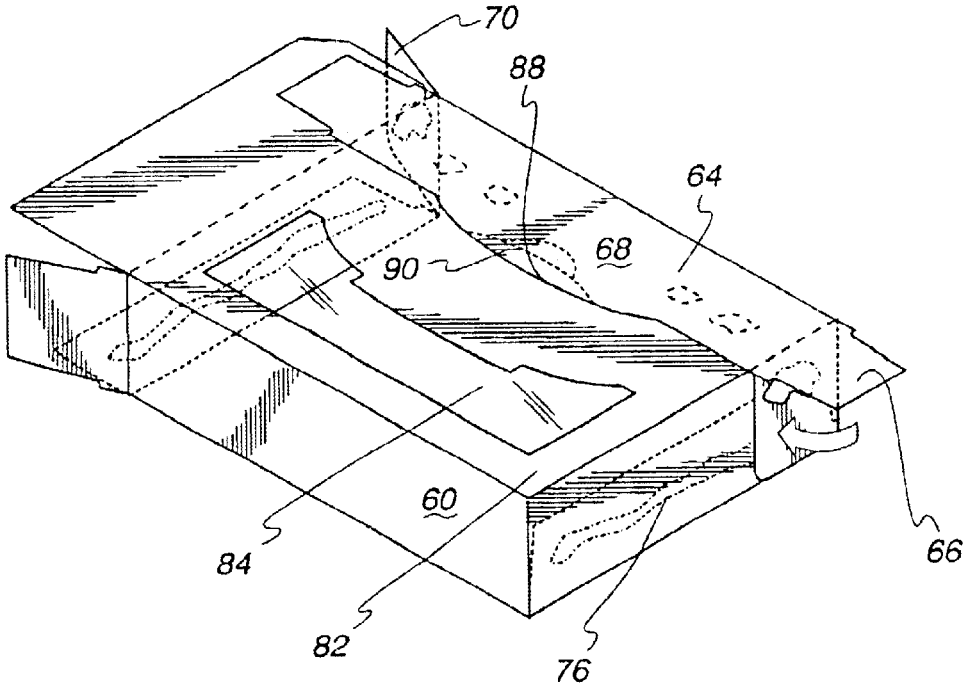
Figure 14:
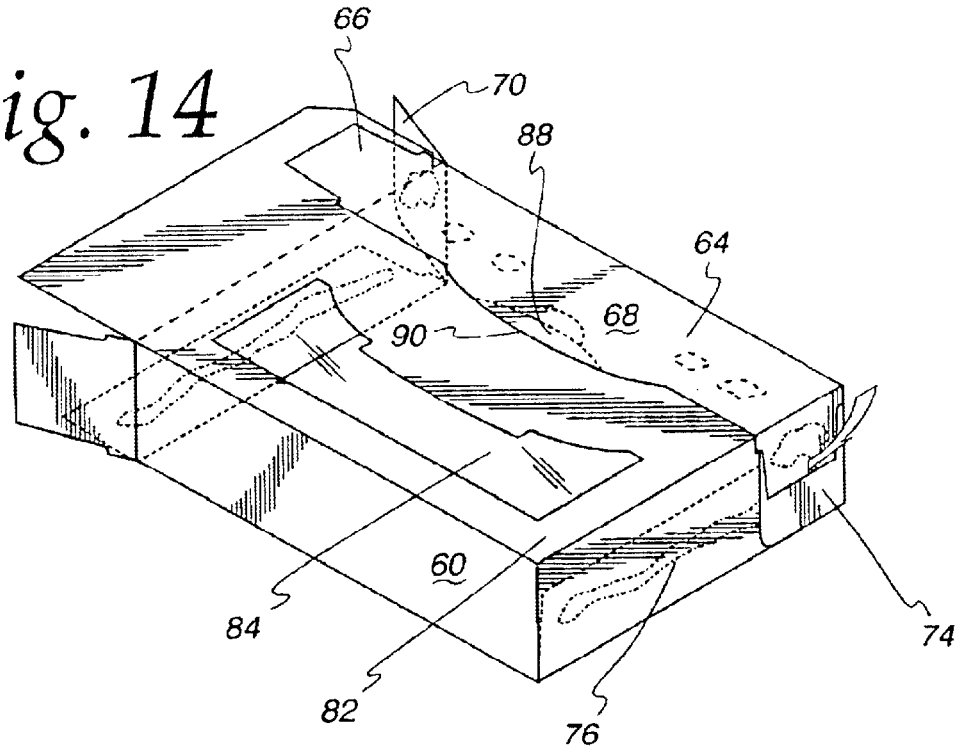

FIGS. 8–22 illustrate a method of assembling the carton of FIG. 7 from a partially pre-glued, partially assembled container. The partially assembled container is initially in a folded flat configuration 94, and includes top, bottom, front and back walls. The front wall comprises a top front wall 68 that will form the front portion of the cover, and a bottom front wall 82 that will form the front wall of the body of the container. The top front wall 68 is releasably secured to the top bottom wall 82 in overlapping relation by adhesive. The back wall 78 includes a line of weakness 80 that will later function as a hinge, separating the back wall into an upper portion that will function as the back wall of the cover, and a lower portion that will function as the back wall of the body of the carton. Each of the walls has first and second side flaps thereon.

In the preferred method of assembly, the partially formed carton is first unfolded so that the front 82 and back walls 78 are spaced from one another, and the first side flap 96 of the bottom wall is folded inward. Next, the first side flaps of the bottom front wall 98 and the back wall 100 are folded inward into overlapping relation with one another and attached to each other to form a first side wall 76 for the body of the carton, while the second side 76 of the partially formed carton remains open. The first flap 98 of the bottom wall need not be glued in place. The next step comprises folding the first side flaps 66 of the top front wall and the top wall 70 inward, and securing them to each other, to form a first side wall 74 for the cover while the second side of the partially formed carton remains open. To facilitate later opening of the finished carton, the side wall 74 of the cover is not secured by adhesive to the side wall 76 of the carton body, but overlaps it to provide security. After the above steps have been completed, one side of the carton is fully formed, and the food products 46 and associated delivery systems 30 may then be inserted through the open second side of the partially finished container. Thereafter, the second side of the carton is enclosed by forming a second side wall 76 for the body and the cover 64 by performing with respect to the second flaps the same steps described above with respect to the first flaps.

Figure 15:
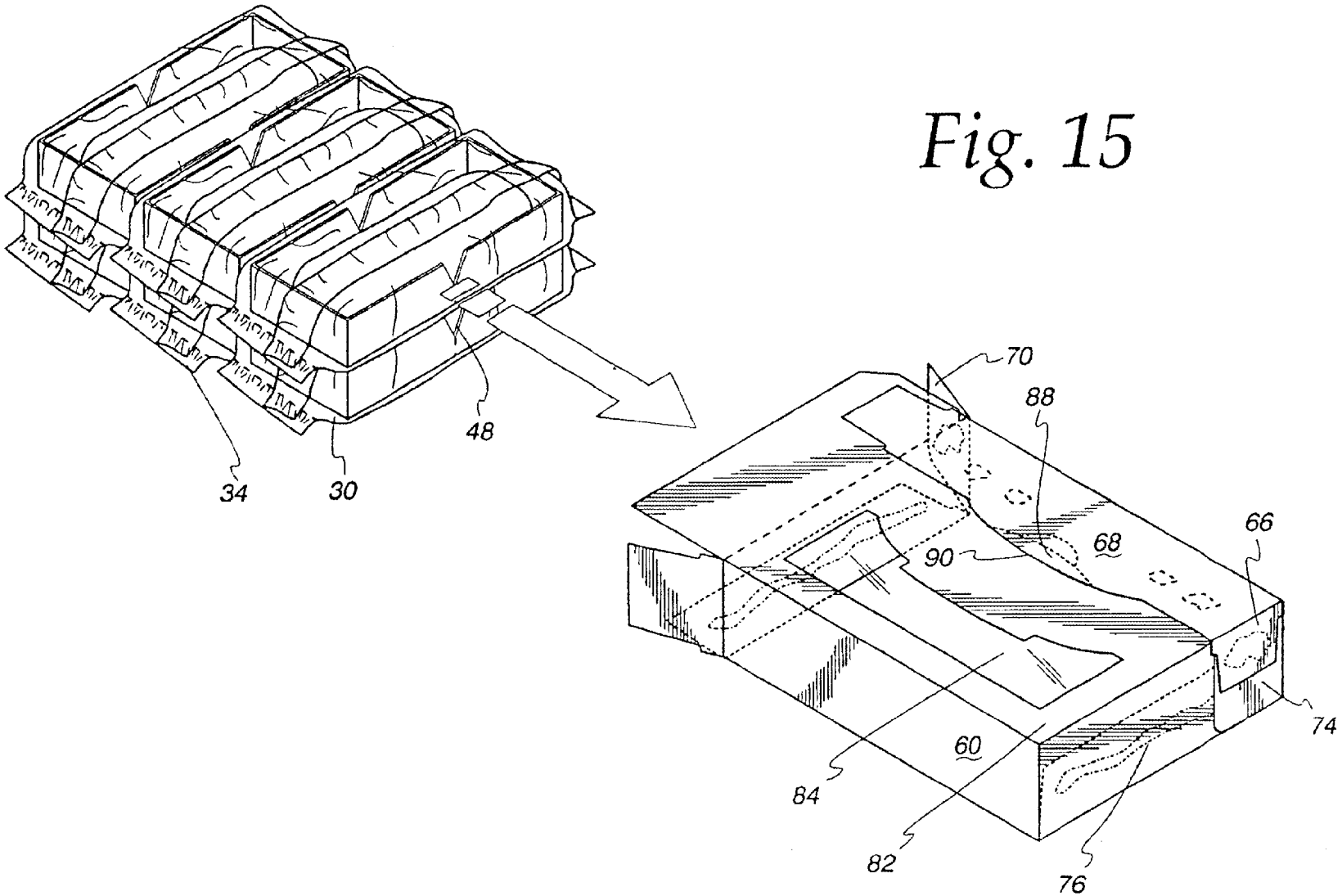
Figure 16:
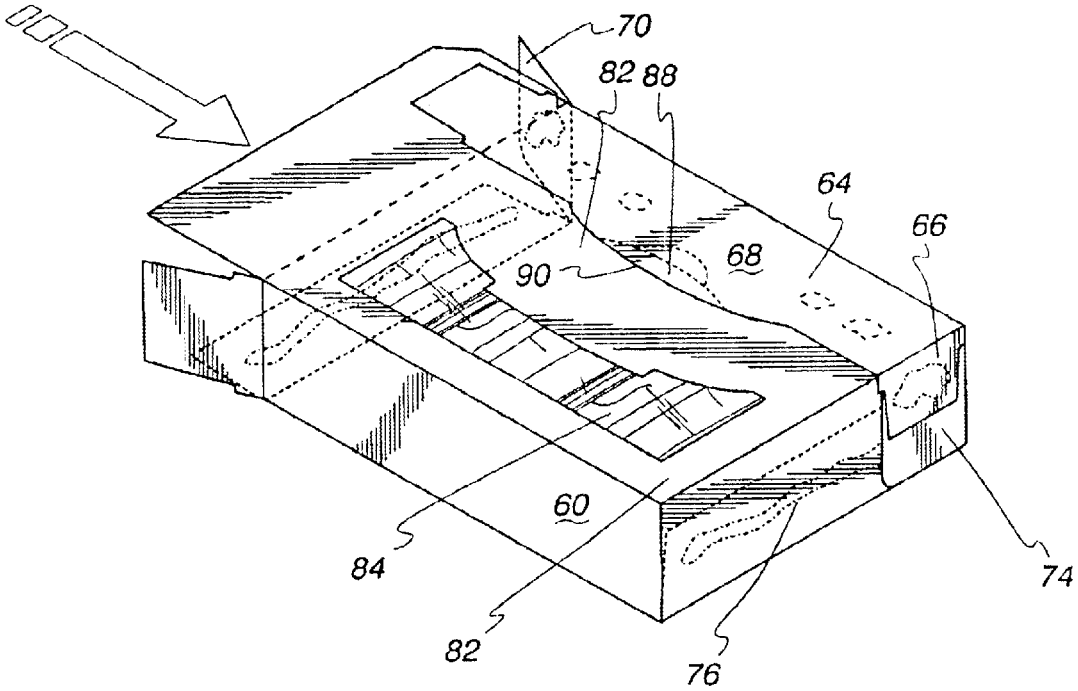
Figure 17:
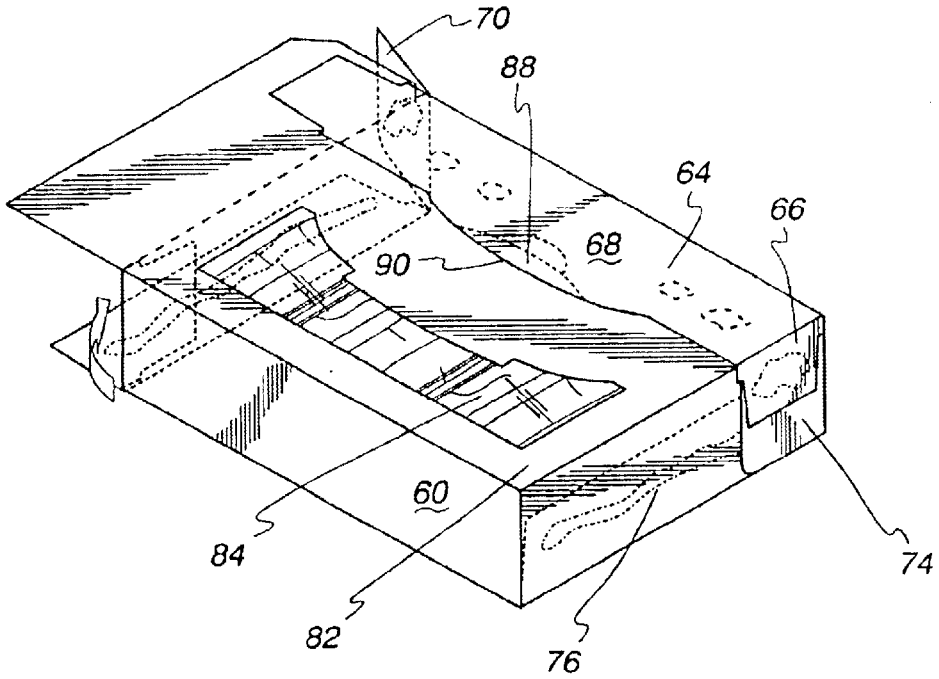
Figure 18:
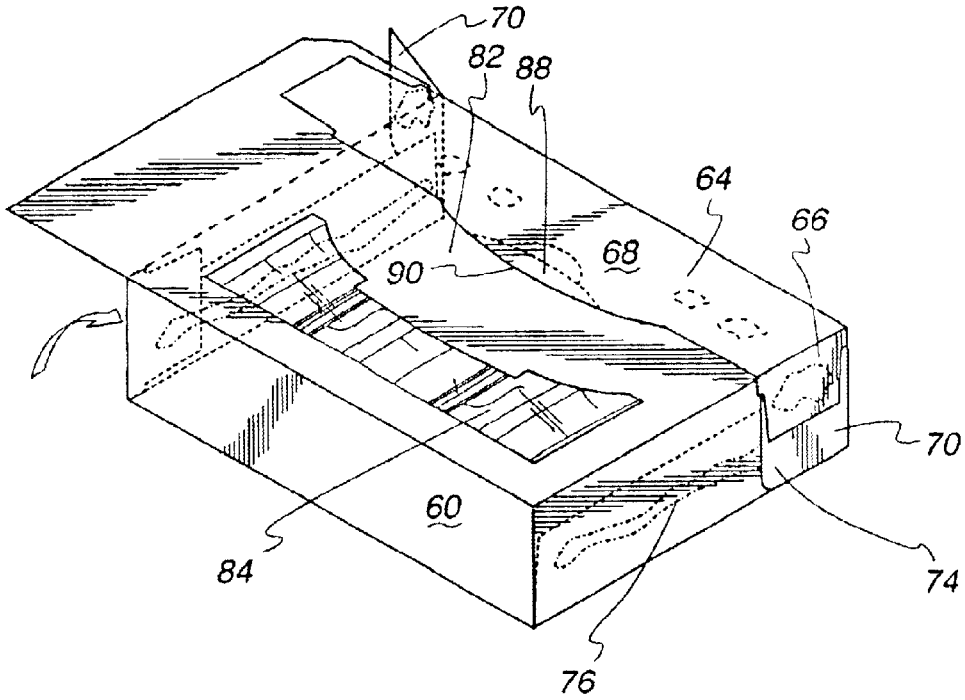
Figure 19:
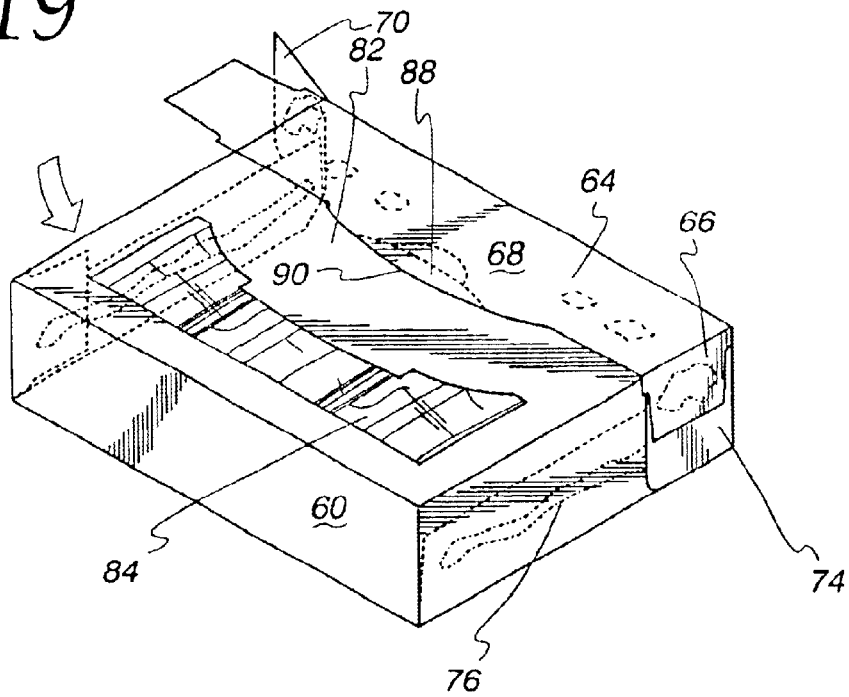
Figure 20:
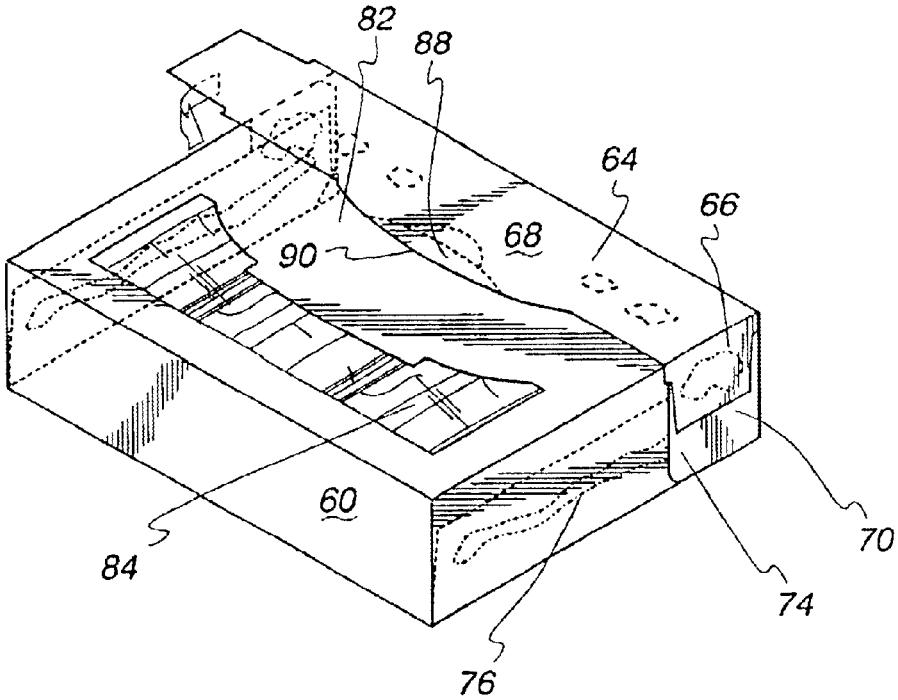
Figure 21:
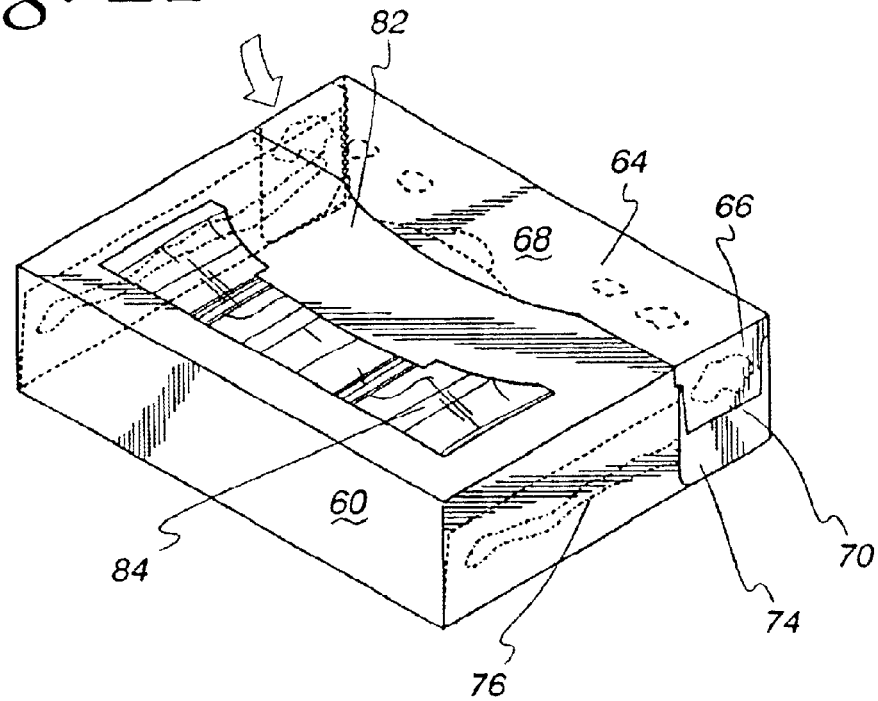
Figure 22:
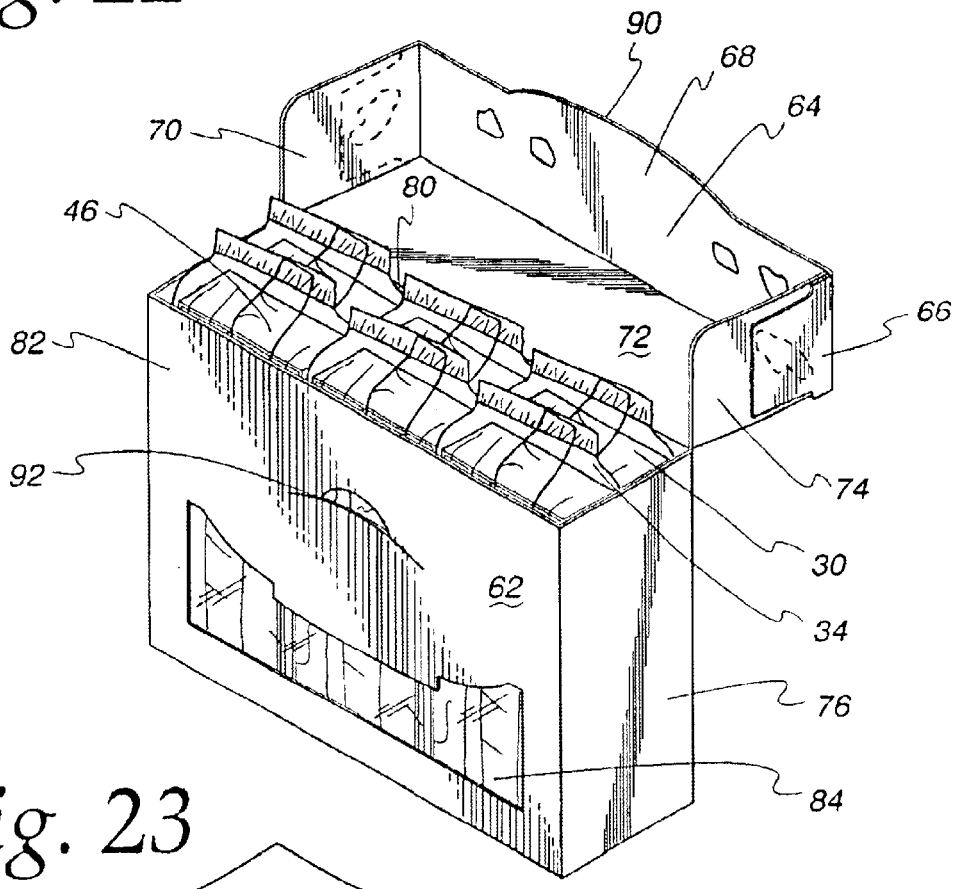
FIG. 22 is a perspective view illustrating the side load carton of FIG. 7 in open position.
Figure 23:
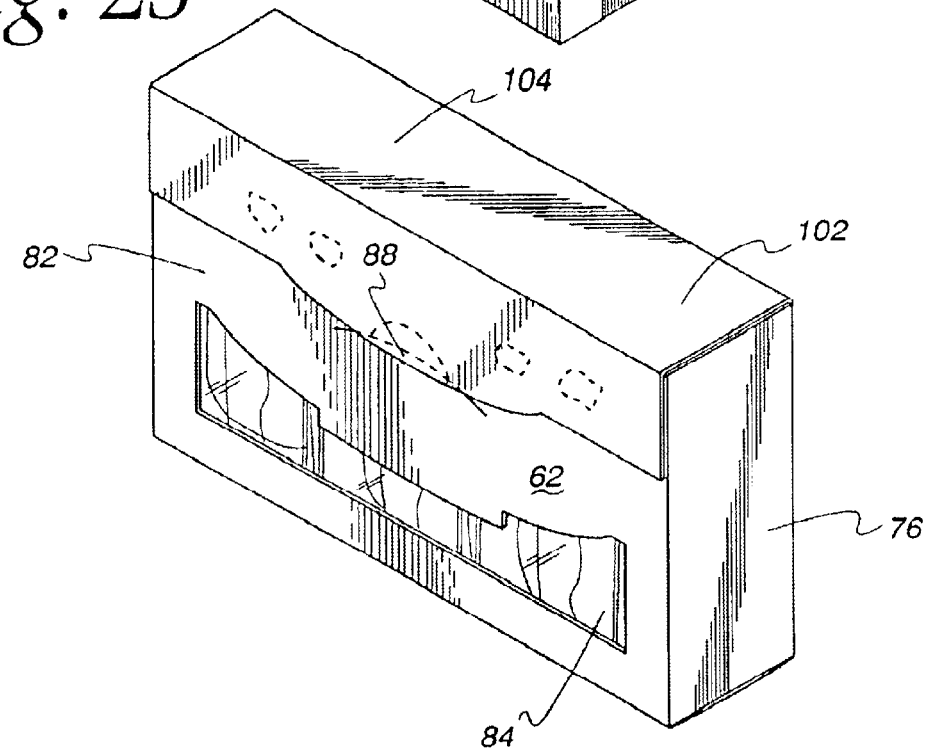
FIG. 23 is a perspective view illustrating an end load carton in accordance with another embodiment of the invention.
Figure 24:
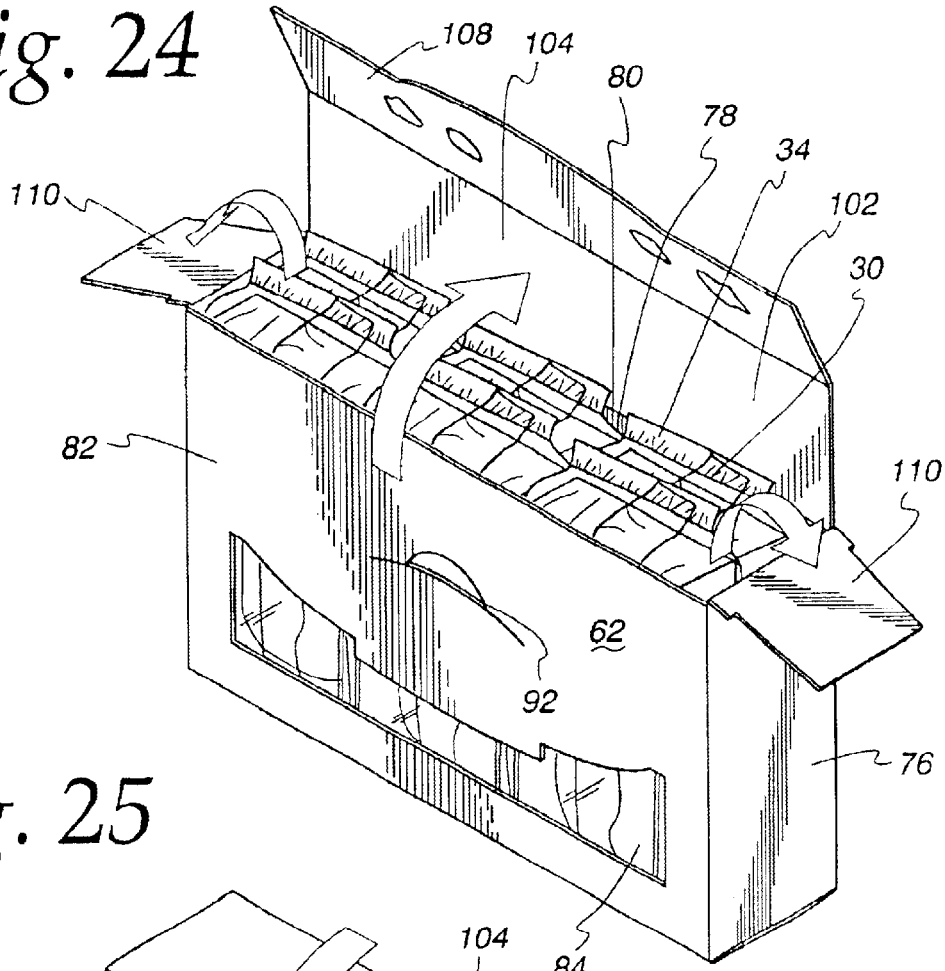
FIG. 24 is a perspective view illustrating the carton of FIG. 23 in open position.
Figure 25:
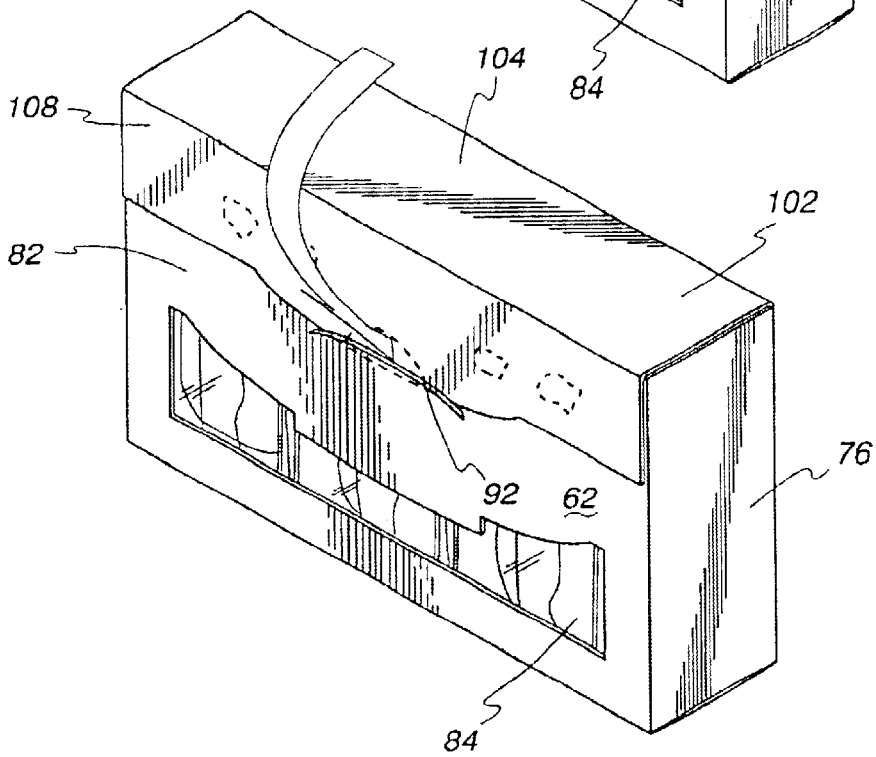
FIG. 25 is a perspective view illustrating the carton of FIG. 23 in a reclosed position.
Figure 26:
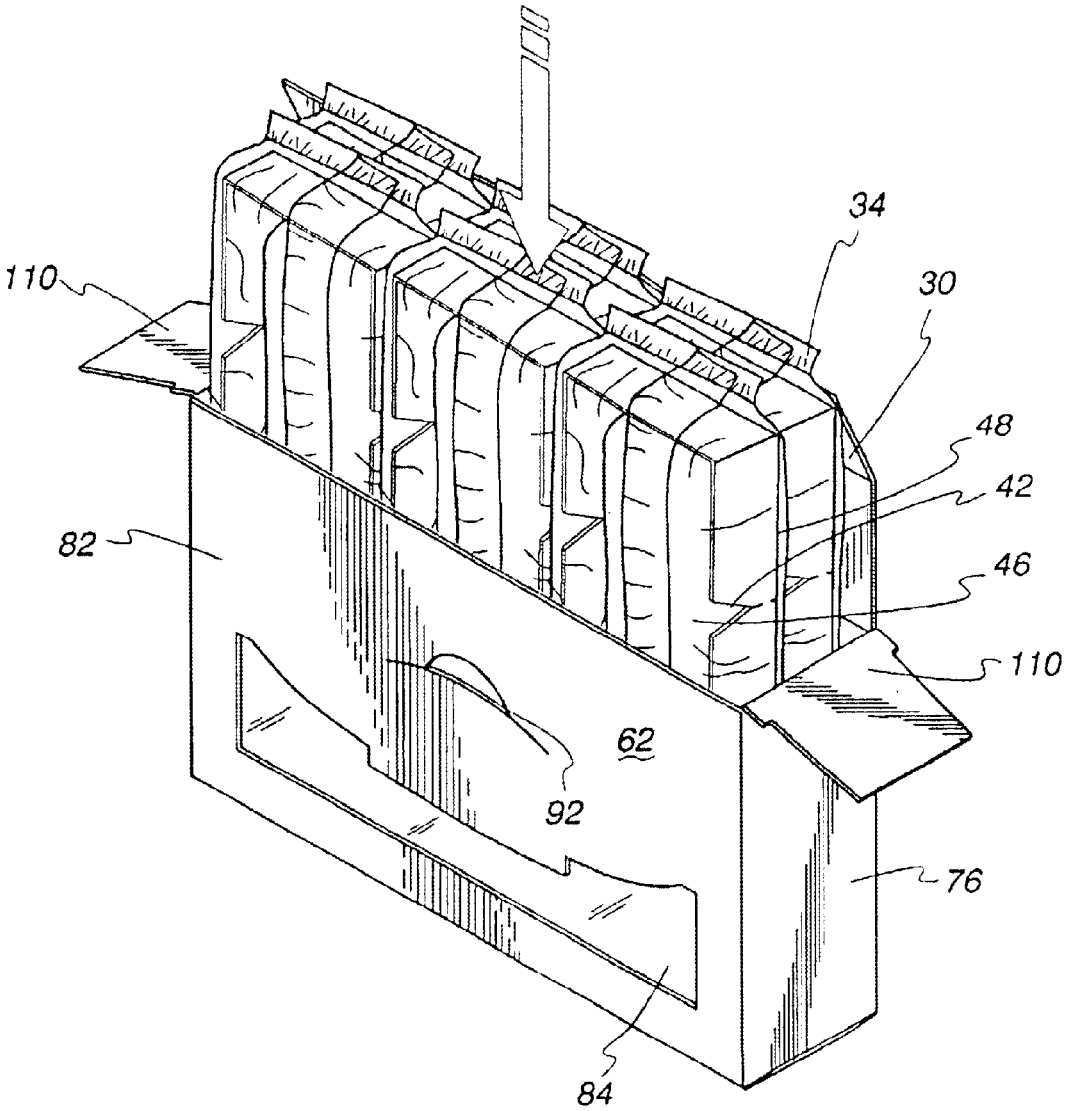
FIGS. 26 and 27 are perspective views illustrating the loading of an end load carton through the top end and bottom end, respectively.

The step of inserting the food products 46 and associated delivery systems 30 preferably comprises arranging the food products and associated delivery systems in two rows, one stacked atop the other, adjacent the open side of the carton, with the carton resting on its back wall 78, and simultaneously pushing the rows into the partially formed carton with a mandrel FIG. 15. The food products and associated delivery systems each have one end disposed adjacent the top wall of the carton, and an opposite end disposed adjacent the bottom wall. The mandrel directly contacts only the delivery system at the end of each row, applying compressive force to a side portion thereof sufficient to insert the entire row into the carton. Thus, force is transmitted through the food products and/or delivery systems nearest the mandrel. The trays in this embodiment have sufficient strength and rigidity to prevent damage to the food products 46 during this operation.

After the carton has been completely formed, filled and sealed, it may then be opened simply by detaching the front wall 68 of the cover from the front wall 82 of the carton, and lifting the cover 64 so that it pivots up and back about the hinge in the back wall. Each wrapped food product 46 is accessible when the cover is opened. Means to hold the cover 46 in a reclosed position are preferably provided 88. In the illustrated embodiment, reclosability is provided by a tab 90 on the front of the cover and a curved slot 92 in the front wall of the body of the carton. A crescent-shaped cutout may be provided above the slit to facilitate reclosing.

End-Load Carton

Figure 27:
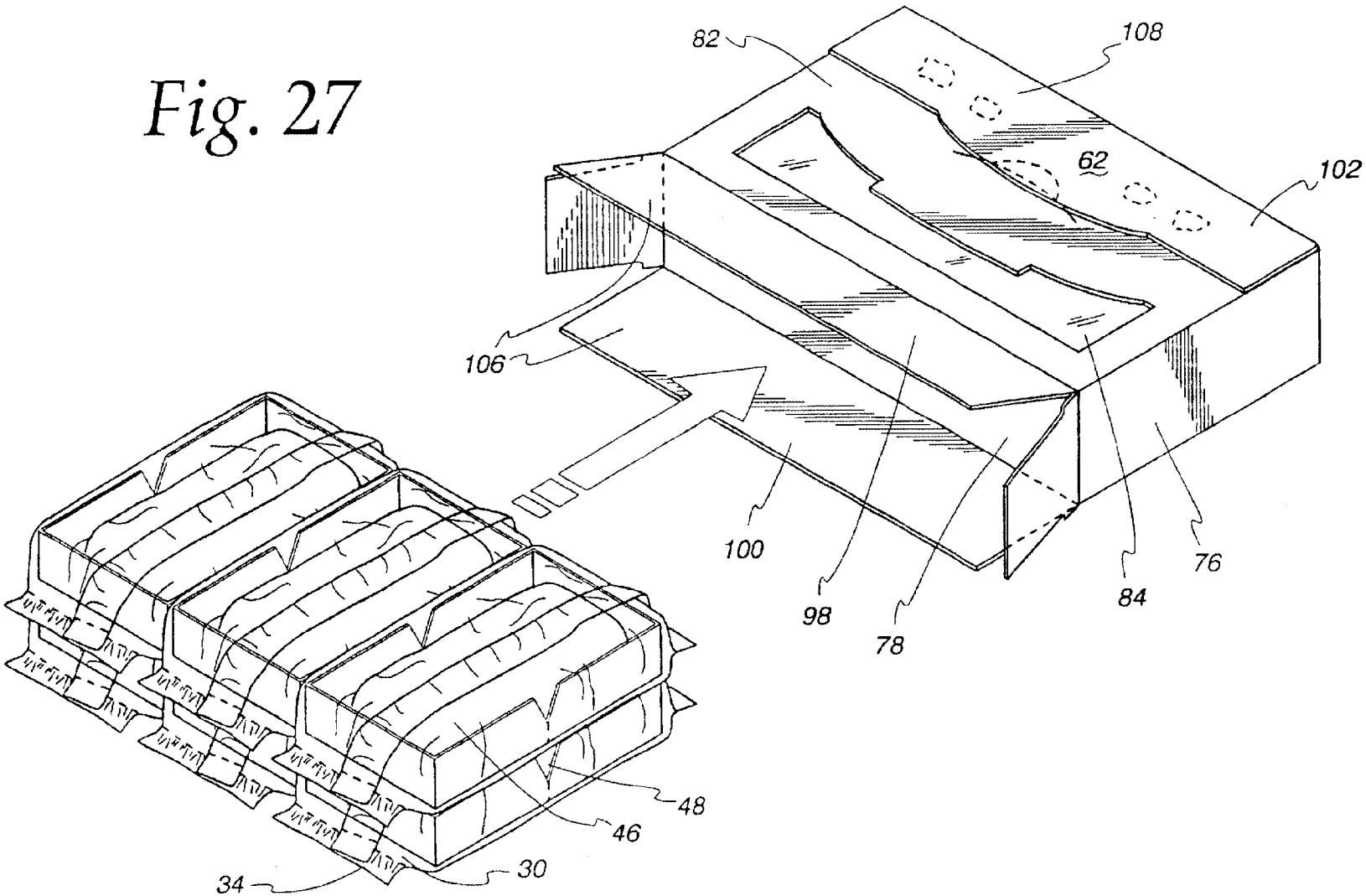
Figure 28:
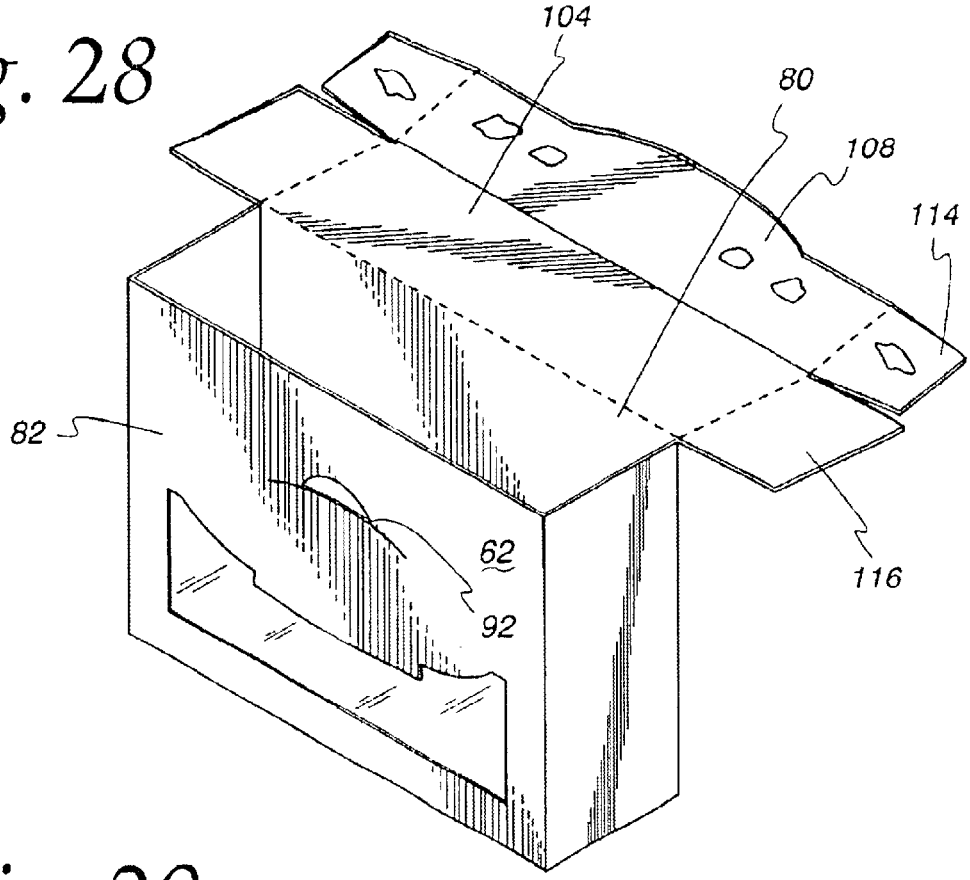
FIG. 28 is a perspective view of another embodiment of the invention, not fully assembled.
Figure 29:
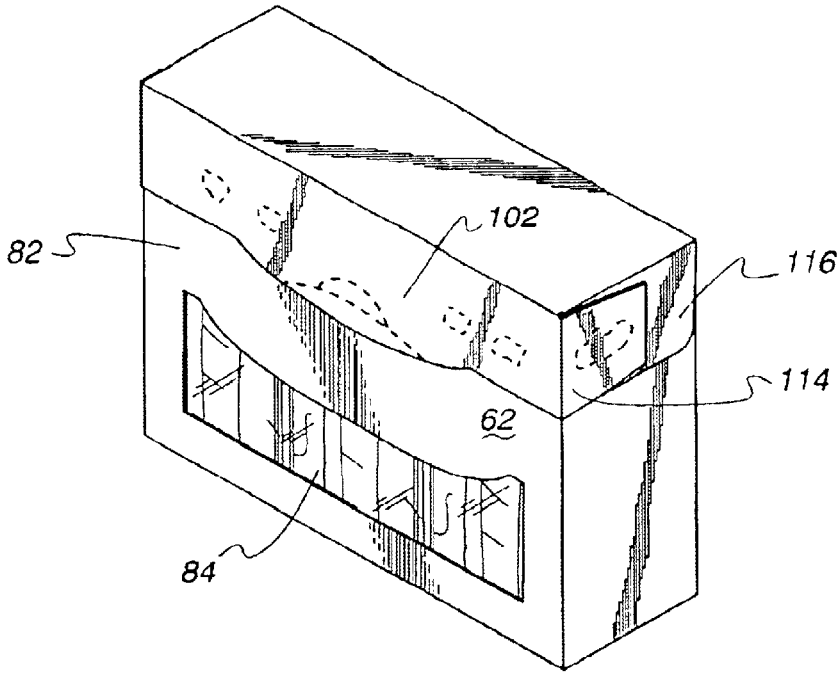
FIG. 29 is a perspective view illustrating the carton of FIG. 28 in closed position.
Figure 30:
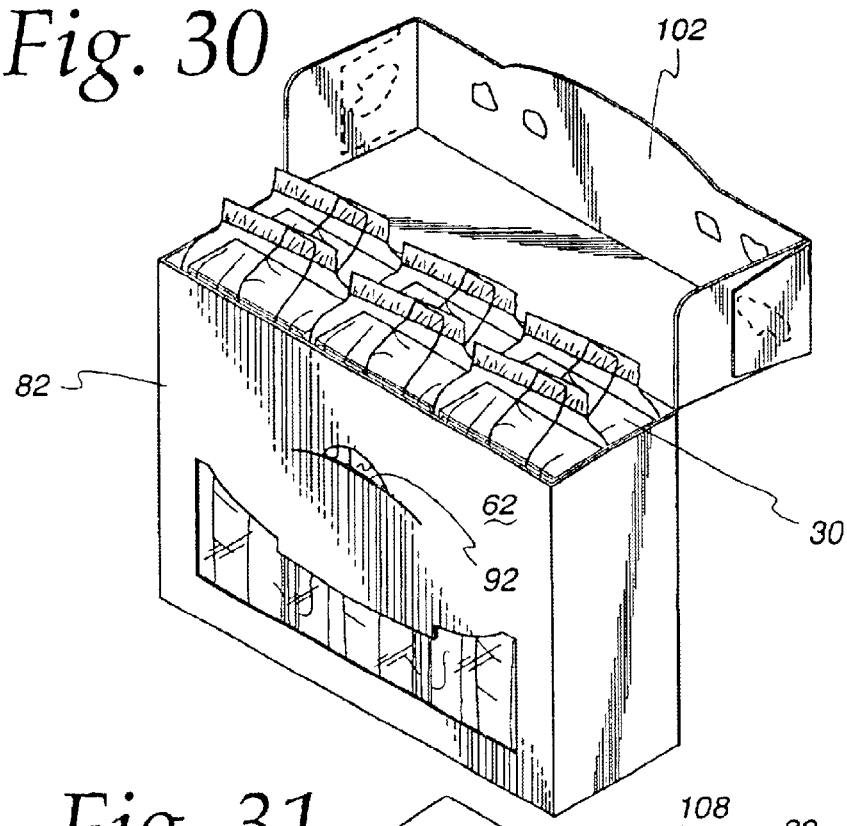
FIG. 30 is a perspective view illustrating the carton of FIG. 28 in open position.
Figure 31:
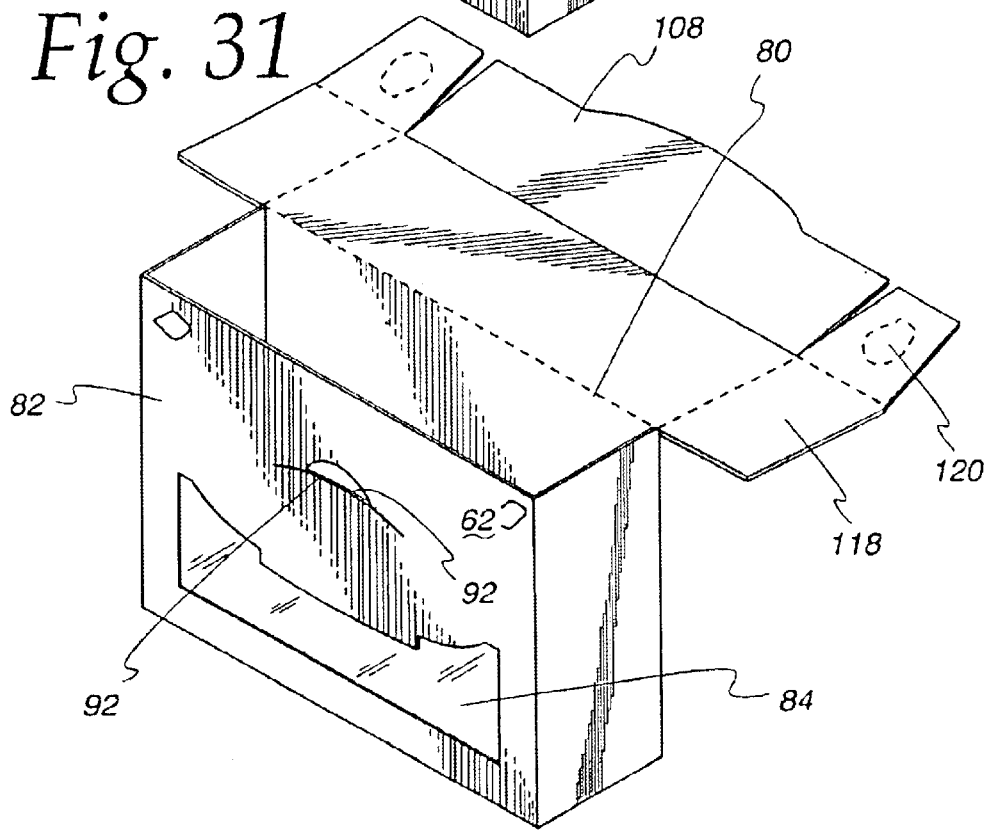
FIG. 31 is a perspective view of another embodiment of the invention, not fully assembled.
Figure 32:
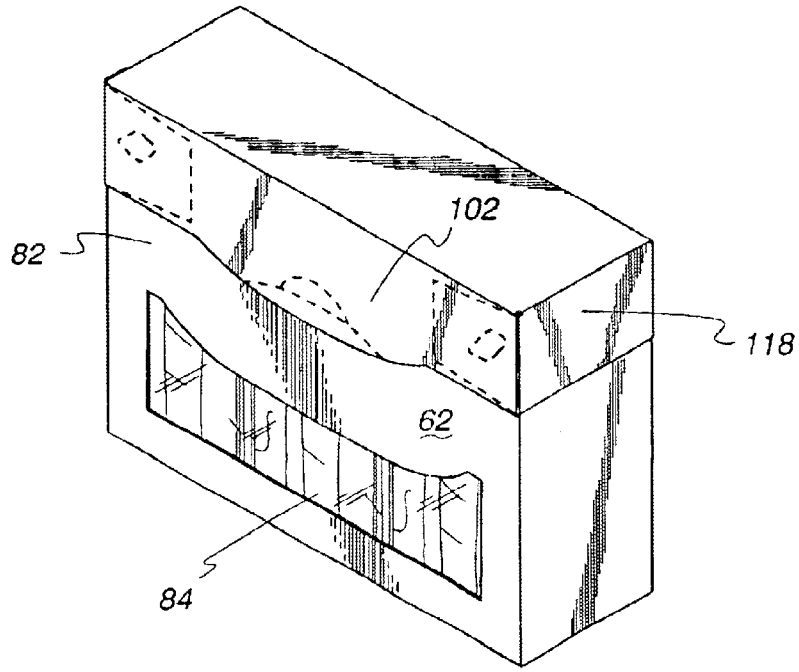
FIG. 32 is a perspective view illustrating the carton of FIG. 31 in closed position.
Figure 33:
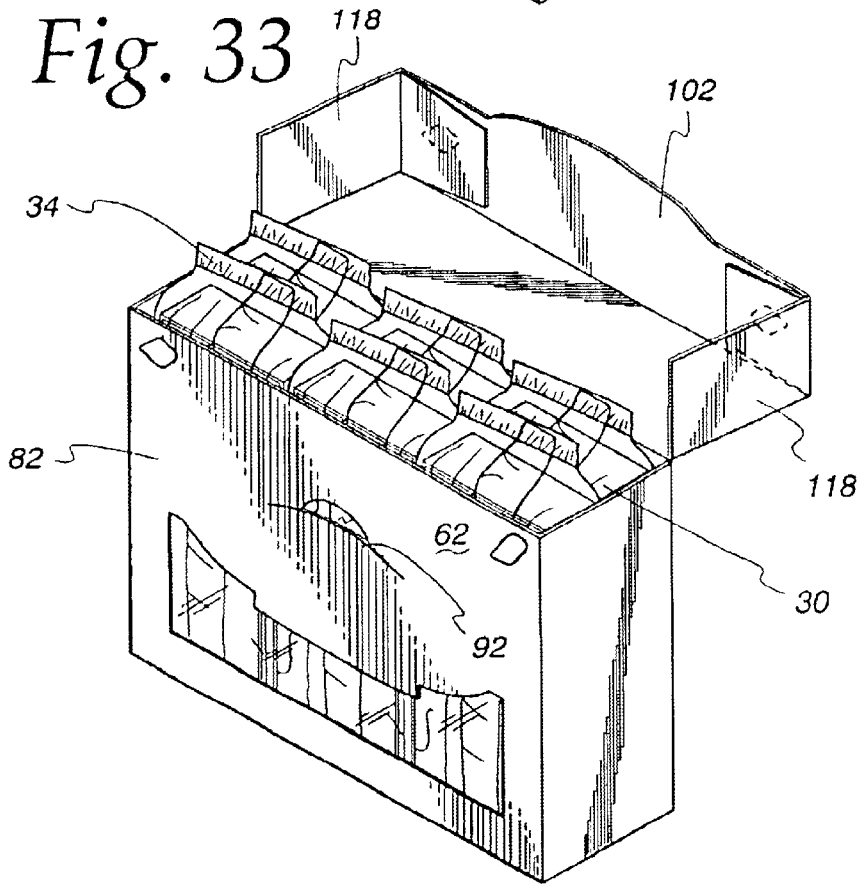
FIG. 33 is a perspective view illustrating the carton of FIG. 31 in open position.

The end-load container 62 of FIGS. 23–33 is generally similar to the side-load container in that it includes generally rectangular front 82, back 78, top 104 and bottom walls 106, and a cover 102 that is joined to the back wall by a hinge 80. However, in one embodiment of the end load container 62, the cover 102 simply comprises a top wall 104 and a front flap 108 that overlies an upper portion of the front wall 82 of the body of the carton, and is releasably secured thereto by adhesive. Flaps 110 at the upper ends of the side walls fold inward to provide security at the ends of the cover 102. The end-load carton 62 may be filled from either the top (FIG. 26) or bottom (FIG. 27) end, with the opposite end closed. In either case, the carton 62 may be in any desired orientation when filled, e.g., an upright position (FIG. 26) or a horizontal position (FIG. 27). In the end-load carton 62, the mandrel may act directly on each of the delivery systems 30, which may reduce compression loads on the delivery systems as compared with the loads experienced by the delivery systems 30 in contact with the mandrel in the above-described filling arrangement for the side-load carton 60, in that none of the food products and associated delivery systems is required to bear the compressive loads associated with pushing another food product and delivery system into place. The cover may be hingedly connected to the back wall 78 along a line of weakness 80 such as a perforation that permits the cover to be easily removed to permit access to food items contained therein. The front wall includes a window 84 to permit visual access to the food items 46 contained therein.

There is another embodiment of the end load carton 62. The cover comprises a top portion 104, two side portions and a front portion 108, wherein the side portions of the cover are formed as two side flaps 114, each attached to opposite ends of said front portion of said cover, wherein said side flaps are glued onto two other side flaps 116, each attached to opposite ends of said top portion of said cover. This arrangement results in a smooth edge at the front two corners of the cover, wherein the other side flaps 116 are folded back onto the side flaps and glued in position. This embodiment creates a box-like cover. This embodiment may be loaded from the top or bottom, depending on which end is assembled first. The front wall includes a window 84 to permit visual access to the food items 46 contained therein.

In yet another embodiment of the end load carton, the cover comprises a top portion 104, two side portions, and a front portion 108. In this embodiment, the side portions are formed as two side flaps, attached to opposite ends of said top portion of the cover 118, to which are attached two top side flaps 120, each of the top side flaps being attached to the front portion of a respective one of the side flaps of the cover, wherein the top side flaps are glued to the inner side of the front portion of the cover. This arrangement results in a box-like cover, with edges of the opposite sides of the front portion at the two front corners. This embodiment may be loaded from the top or the bottom, depending upon which end is assembled first. The front wall includes a window 84 to permit visual access to the food items 46 contained therein.

We claim:

1. A method of forming and filling in an automated filling operation a container suitable for shipping, display and consumer use having a body and a cover from an open-ended, partially pro-glued, partially assembled container comprising top, top front, top side, bottom front, bottom back, and bottom side flaps, comprising:

(a) folding the top side flaps inward;

(b) thereafter folding the top and top front so that the top front overlaps in part the front of the container, and attaching the top front to the front of the package to provide a closed top and an open bottom for the container;

(c) providing a plurality of wrapped food products, having opposed ends, each wrapped food product comprising an elongated food product, an elongated food delivery tray system, and an elongated flexible sheet wrap overlying the elongated food delivery tray system having end seals at opposite ends thereof to seal the elongated food product, each elongated food delivery tray system comprising an elongated tray that has sufficient strength and stiffness to withstand compression loads experienced during packaging and to shield the elongated food product from the compression loads, said, including a bottom wall, a pair of side walls joined to the bottom wall, and a pair of end walls adjacent the wrapped food product ends and joined to the bottom wall, each of said side walls having at least one notch extending from an upper edge of the side wall, along a portion of the height of each side wall and a line of weakness extending from the bottom of each notch to the bottom wall, and one or more curved recesses in the upper edges of the side walls and spaced from the at least one notch to facilitate handling;

(d) inserting said plurality of wrapped food products simultaneously through the open bottom by applying compressive force to one of the end walls of all of said wrapped food products simultaneously with a mandrel, so as to transmit the compressive force along said sidewalls to the other of the end walls, in a direction extending along the longitudinal axis of the elongated food product thereby urging said wrapped food products longitudinally into the container, with said wrapped food products being arranged so that said mandrel acts directly on each of the end walls of the delivery tray systems and each of said wrapped food products will have an end seal readily accessible without restriction from the top of the container when the container is opened;

(e) folding the bottom side flaps inward;

(f) folding either the bottom front or the bottom back flap inward;

(g) folding the remaining bottom flap inward; and (h) fastening the flap folded in step (g) to the flap folded in step (f).

2. The method of claim 1 wherein attaching the top front to the front of the package comprises releasable attachment by adhesive.

3. The method of claim 2 further comprising providing a line of weakness joining the top to the body of the container to facilitate removal of the top from the container.

4. The method of claim 3 wherein the recesses are provided by die-cutting the upper regions of the side walls.

5. The method of claim 4 wherein each of the notches in the sidewalls comprises a notch extending between about ¼ and about ¾ of the distance from the top edge of the side wall to the bottom edge of the side wall.

6. The method of claim 5 wherein said tray is formed from a flat blank and the corners are locked together without requiring adhesive, and without requiring manual assembly.

7. The method of claim 6 wherein the food product comprises a cream cheese component disposed within a larger farinaceous component or sandwiched between a pair of farinaceous components.

8. The method of claim 7 wherein each farinaceous component comprises a baked bread product or a bagel product.

9. The method of claim 8 wherein the length of the tray is between about 3.5 in. and about 5.5 in., and the width of the tray is between 1 in. and about 3 in., and the depth of the tray is between about 0.5 in. and about 1.5 in.

10. The method of claim 9 wherein the tray and container are made of paperboard having a thickness of about 0.01 to 0.025 in.

11. The method of claim 8 wherein the tray and container are made from paperboard having a thickness of about 0.015 to about 0.022 in.

12. The method of claim 8 wherein the height of the carton is between about 4.5 in. and about 6.5 in., the width of the carton is between about 8 in. and about 10 in., and the depth of the carton is between about 1.5 in and about 3.0 in.

* * * * *

UNITED STATES PATENT AND TRADEMARK OFFICE

CERTIFICATE OF CORRECTION

PATENT NO. : 6,892,513 B1
DATED : May 17, 2005
INVENTOR(S) : Barr et al.

It is certified that error appears in the above-identified patent and that said Letters Patent is hereby corrected as shown below:

Column 9,
Line 39, change "pro-glued", to -- pre-glued --.

Signed and Sealed this

Thirtieth Day of August, 2005

JON W. DUDAS
*Director of the United States Patent and Trademark Office*